US007249390B2

(12) United States Patent
Yale et al.

(10) Patent No.: US 7,249,390 B2
(45) Date of Patent: Jul. 31, 2007

(54) MULTIPURPOSE TOOL INCLUDING HOLDER FOR REPLACEABLE TOOL BLADES

(75) Inventors: Melissa C. Yale, Portland, OR (US); Hollan A. Tsuda, Portland, OR (US); Glenn Klecker, Silverton, OR (US); Benjamin C. Rivera, West Linn, OR (US)

(73) Assignee: Leatherman Tool Group, Inc., Portland, OR (US)

( * ) Notice: Subject to any disclaimer, the term of this patent is extended or adjusted under 35 U.S.C. 154(b) by 101 days.

(21) Appl. No.: 11/031,752

(22) Filed: Jan. 7, 2005

(65) Prior Publication Data

US 2006/0150340 A1 Jul. 13, 2006

(51) Int. Cl.

| | |
|---|---|
| ***B25B 7/22*** | (2006.01) |
| *B26B 3/06* | (2006.01) |
| *F41B 13/02* | (2006.01) |
| *F41C 27/18* | (2006.01) |

(52) U.S. Cl. ..... 7/128; 30/156

(58) Field of Classification Search ..... 7/128, 7/125–127, 168; 30/156, 157

See application file for complete search history.

(56) References Cited

U.S. PATENT DOCUMENTS

| | | | | |
|---|---|---|---|---|
| 515,828 | A | 3/1894 | Hayden | |
| 580,235 | A | 4/1897 | Strum | |
| 595,909 | A | 12/1897 | Evertz | |
| 696,995 | A | 4/1902 | Moser | |
| 1,361,021 | A | 12/1920 | Copeman | |
| 1,444,324 | A * | 2/1923 | Brooks | 30/156 |
| 1,467,661 | A | 9/1923 | Undy | |
| 1,828,121 | A | 10/1931 | Adam et al. | |
| 1,935,812 | A | 11/1933 | Moody | |
| 2,439,071 | A | 4/1948 | Basham | |
| 2,914,850 | A * | 12/1959 | Kuhnl | 30/156 |
| 3,641,667 | A * | 2/1972 | Leopoldi | 30/2 |
| 4,073,057 | A * | 2/1978 | Gilbert | 30/153 |
| 4,169,312 | A | 10/1979 | Mar | |
| 4,233,737 | A | 11/1980 | Poehlmann | |

(Continued)

FOREIGN PATENT DOCUMENTS

| | | |
|---|---|---|
| FR | 2760955 | 9/1998 |

(Continued)

OTHER PUBLICATIONS

W.R. Case & Sons Cutlery Co., xxChanger, Exchangeable Blade Knife, Photocopy of Owner's Manual, Copyright 1987.

(Continued)

*Primary Examiner*—Lee D. Wilson
*Assistant Examiner*—Alvin J. Grant
(74) *Attorney, Agent, or Firm*—Chernoff, Vilhauer, McClung & Stenzel, LLP

(57) ABSTRACT

A multipurpose folding hand tool including a tool holder permitting exchanges of blades. The tool may include a folding scissors including a spring that is moved into operative engagement with a scissors handle to open the scissors handles apart from each other only as the scissors approaches an extended, operative position with respect to the handle of the folding land tool, within which it may be stowed. A resilient grip member is incorporated in one of the handles of the folding multipurpose hand tool. A wire cutter and a crimping tool are located on pliers jaw tangs, between the pliers pivot and the foldable handles of the tool.

12 Claims, 10 Drawing Sheets

U.S. PATENT DOCUMENTS

| | | | | |
|---|---|---|---|---|
| 4,238,862 | A | 12/1980 | Leatherman | |
| 4,261,103 | A | 4/1981 | Heck | |
| 4,391,043 | A | 7/1983 | Sizemore et al. | |
| 4,442,600 | A | 4/1984 | Felix-Dalichow | |
| 4,648,148 | A | 3/1987 | Miceli | |
| 4,669,140 | A | 6/1987 | Miceli | |
| 4,669,188 | A | 6/1987 | Evrell | |
| 4,888,869 | A | 12/1989 | Leatherman | |
| 4,995,128 | A | 2/1991 | Montgomery et al. | |
| 5,014,379 | A | 5/1991 | Hull et al. | |
| 5,033,140 | A | 7/1991 | Chen et al. | |
| 5,044,079 | A | 9/1991 | Gibbs | |
| 5,095,624 | A | 3/1992 | Ennis | |
| 5,245,721 | A | 9/1993 | Lowe et al. | |
| 5,251,353 | A | 10/1993 | Lin | |
| 5,280,659 | A | 1/1994 | Park | |
| 5,461,786 | A | 10/1995 | Miller | |
| 5,511,310 | A | 4/1996 | Sessions et al. | |
| 5,586,847 | A | 12/1996 | Mattern, Jr. et al. | |
| 5,647,129 | A | 7/1997 | Stamper | |
| 5,653,525 | A | 8/1997 | Park | |
| 5,685,079 | A | 11/1997 | Brothers et al. | |
| 5,692,304 | A | 12/1997 | Campbell | |
| 5,711,194 | A | 1/1998 | Anderson et al. | |
| 5,765,247 | A | 6/1998 | Seber et al. | |
| 5,781,950 | A | 7/1998 | Swinden | |
| 5,791,002 | A | 8/1998 | Gardiner et al. | |
| 5,799,400 | A | 9/1998 | Glesser | |
| 5,809,600 | A | 9/1998 | Cachot | |
| 5,822,867 | A | 10/1998 | Sakai | |
| 5,857,268 | A | 1/1999 | Park | |
| D407,286 | S | 3/1999 | Seber et al. | |
| 5,933,893 | A | 8/1999 | Padden | |
| 5,946,752 | A | 9/1999 | Parrish | |
| 5,979,059 | A | 11/1999 | Leatherman | |
| 6,000,080 | A | 12/1999 | Anderson et al. | |
| 6,003,180 | A | 12/1999 | Frazer | |
| 6,009,582 | A | 1/2000 | Harrison et al. | |
| 6,014,787 | A | 1/2000 | Rivera | |
| 6,082,232 | A | 7/2000 | Anderson et al. | |
| 6,088,861 | A | 7/2000 | Sessions et al. | |
| 6,109,148 | A | 8/2000 | Anderson et al. | |
| 6,113,617 | A * | 9/2000 | van der Merwe | 606/167 |
| 6,119,560 | A | 9/2000 | Anderson et al. | |
| 6,145,851 | A | 11/2000 | Heber | |
| 6,233,769 | B1 | 5/2001 | Seber et al. | |
| 6,243,901 | B1 | 6/2001 | Elsener et al. | |
| 6,257,106 | B1 | 7/2001 | Anderson et al. | |
| 6,260,453 | B1 | 7/2001 | Anderson et al. | |
| 6,276,435 | B1 | 8/2001 | Zayat, Jr. | |
| 6,282,996 | B1 | 9/2001 | Berg et al. | |
| 6,282,997 | B1 | 9/2001 | Frazer | |
| 6,286,397 | B1 | 9/2001 | Taggart et al. | |
| 6,289,541 | B1 | 9/2001 | Anderson et al. | |
| 6,298,756 | B1 | 10/2001 | Anderson et al. | |
| 6,305,041 | B1 | 10/2001 | Montague et al. | |
| 6,318,218 | B1 | 11/2001 | Anderson et al. | |
| 6,331,087 | B1 | 12/2001 | Wang | |
| 6,357,068 | B1 | 3/2002 | Seber et al. | |
| 6,370,778 | B1 | 4/2002 | Conable | |
| 6,389,625 | B1 | 5/2002 | Rivera | |
| 6,397,709 | B1 | 6/2002 | Wall | |
| D460,332 | S | 7/2002 | Seber | |
| 6,438,848 | B1 | 8/2002 | McHenry et al. | |
| 6,453,564 | B1 * | 9/2002 | Foley | 30/359 |
| 6,481,034 | B2 | 11/2002 | Elsener et al. | |
| 6,510,767 | B1 | 1/2003 | Rivera | |
| 6,574,868 | B1 | 6/2003 | Overholt | |
| 6,578,221 | B2 | 6/2003 | Ping | |
| 6,578,222 | B2 | 6/2003 | Anderson | |
| 6,691,357 | B2 | 2/2004 | Rivera | |
| 6,763,543 | B2 | 7/2004 | Rivera | |
| 6,779,212 | B2 | 8/2004 | Anderson et al. | |
| 2001/0018778 | A1 | 9/2001 | Montague et al. | |
| 2001/0037705 | A1 | 11/2001 | Frazer | |
| 2003/0037644 | A1 | 2/2003 | Rivera | |
| 2003/0062055 | A1 | 4/2003 | Park | |
| 2004/0237207 | A1 | 12/2004 | Rivera | |

FOREIGN PATENT DOCUMENTS

| | | |
|---|---|---|
| WO | WO9937446 | 7/1999 |

OTHER PUBLICATIONS

Wenger of Switzerland, WengerGrip Series, Photocopy of instruction sheet, at least as early as Nov. 1996.

Fiskars, Inc., Multi-Snip Tool Kit, Photocopy of instruction sheet and photos, at least as early as Aug. 1996.

Kershaw Knives, Multi-Tool Model A100, Photocopy from catalog and instruction sheet, at least as early as Jan. 1998.

Gerber Folding Multipurpose Tool with Holder for Replaceable Saw Blade, Photocopy of photos, at least as early as Aug. 1998.

Gerber Multi-Lock Multi-Plier Tool Kit, Photocopy of packaging, instruction sheet and photos, at least as early as Jan. 2004.

Gerber Legendary Blades Tool with Replaceable Saw Blade Coupler, Photocopy of instruction sheet and photos, at least as early as Aug. 2004.

Kershaw Blade Traders Camp Tool, Photocopy of instruction sheet and photos, at least as early as Aug. 2004.

Gerber Freeman Exchange-a-Blade, Photocopy of instruction sheet and photos, at least as early as Aug. 2004.

* cited by examiner 56
110
112
114
92
98
94
128
96
102
115
84
100
82
104
90
88
132
85
80
86
108
70
106
79
68
60
89
72
58
74
76
214
210
116
78
118
126
130
120
54
70'

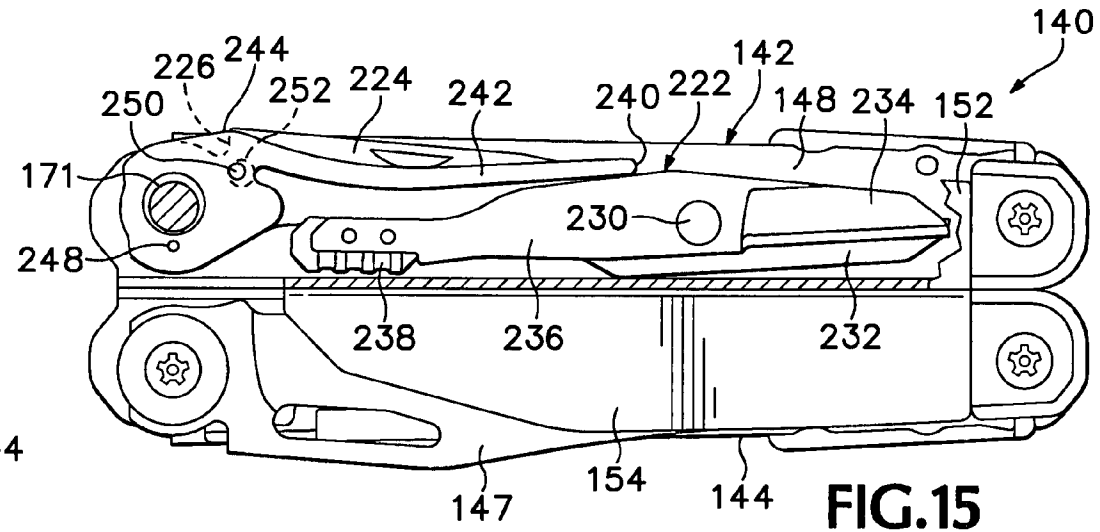
FIG.15
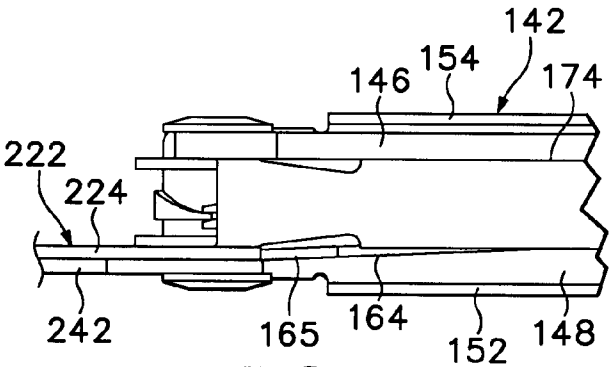
FIG.14
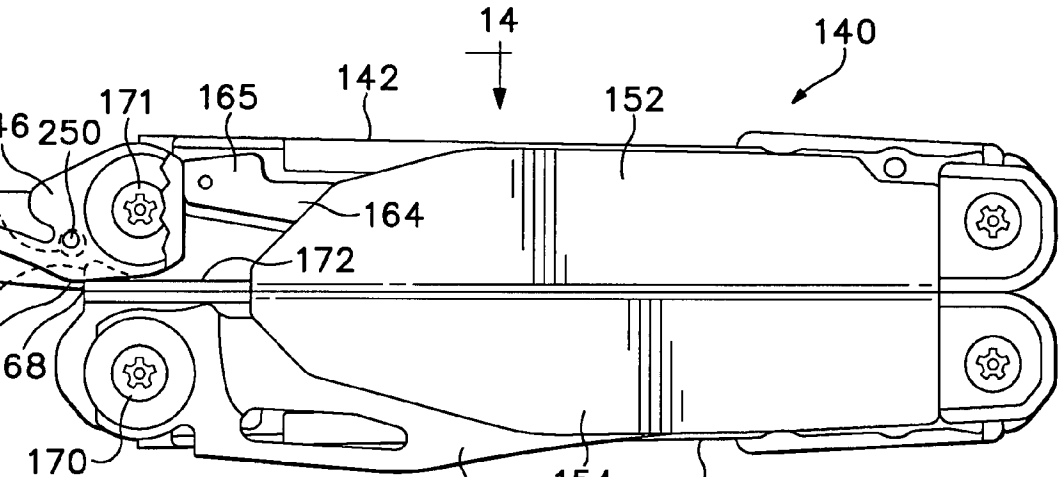
FIG.13
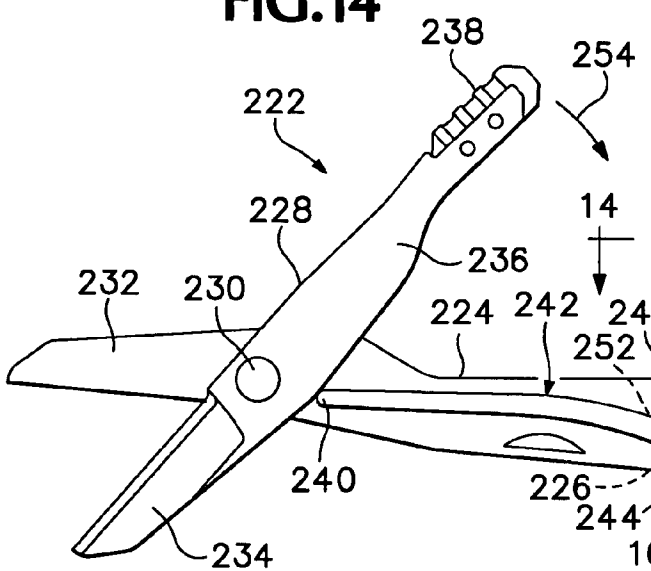

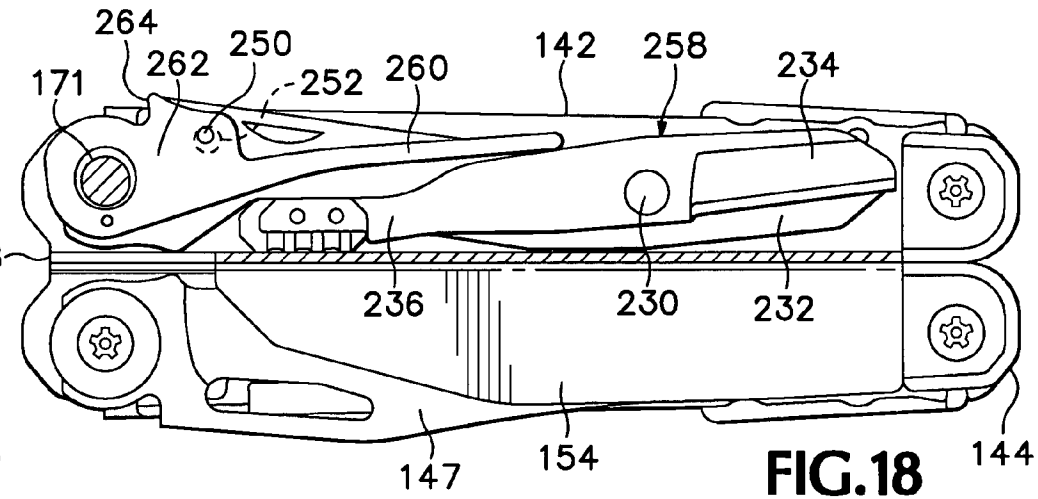
FIG.18
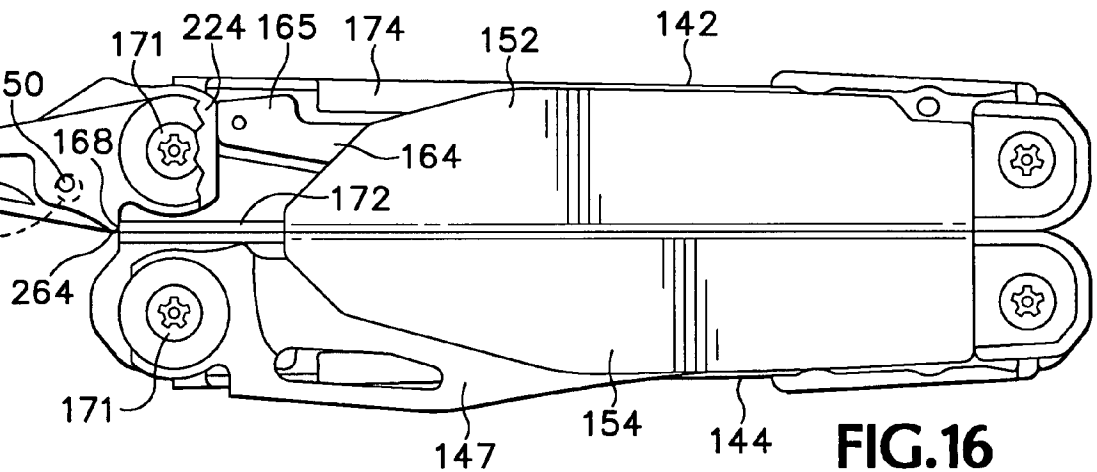
FIG.16
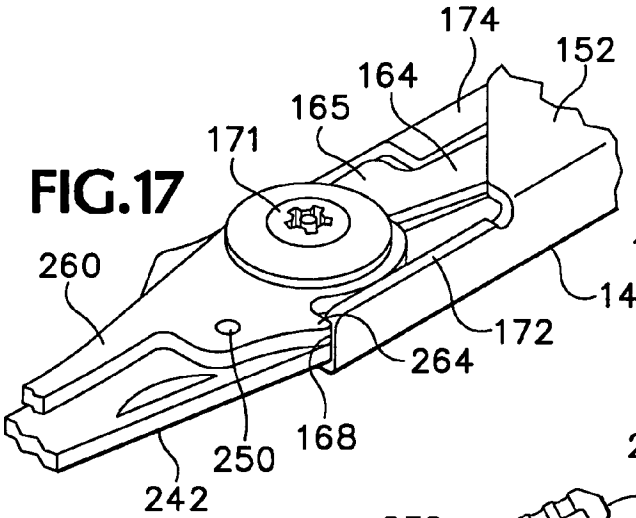
FIG.17
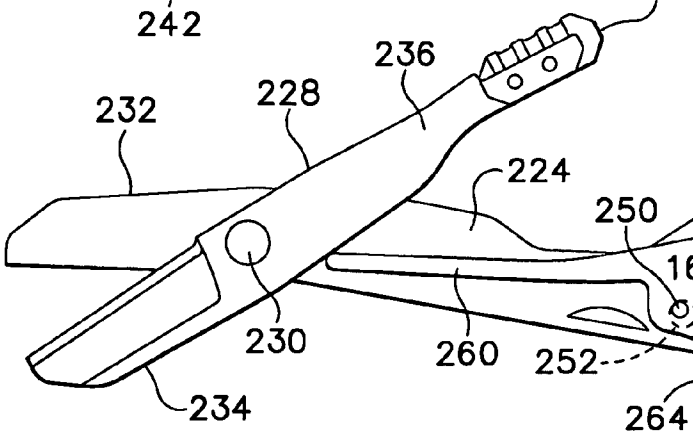

MULTIPURPOSE TOOL INCLUDING HOLDER FOR REPLACEABLE TOOL BLADES

BACKGROUND OF THE INVENTION

The present invention relates to folding multipurpose hand tools, and in particular relates to such a tool including provision for exchanging tool blades and to such a tool including folding scissors.

Various arrangements are known by which blades and tool bits can be exchanged or replaced in hand tools. In particular, Basham, U.S. Pat. No. 2,439,071, Copeman, U.S. Pat. No. 1,361,201, Gilbert, U.S. Pat. No. 4,073,057, Sizemore, et al., U.S. Pat. No. 4,391,043, and Frazer, U.S. Pat. No. 6,282,997 all disclose hand tools permitting exchange of blades or bits such as screwdriver bits, but the mechanisms for engaging replaceable blades or bits in the prior art have not been well adapted to use in mounting blades or bits so that they can easily be folded into a handle for stowage in a compact folded configuration of the tool.

Many different types of small folding scissors are known and are incorporated in various folding multipurpose hand tools. Many of such scissors include springs to open the handles, and thus open the blades, apart from each other, but folding such previously known scissors to permit stowage in a tool handle has typically required either that the spring be flexed and remain under load when the scissors are folded and stowed, or has required the handles to be pivoted wide apart from each other into opposing positions. These requirements have thus significantly limited the size, and thus the practical utility, of such scissors in the past. For example, in the scissors disclosed in Rivera, et al., U.S. Pat. No. 6,389,625, while there is an adequate spring to open the handles and blades apart from each other after a cutting stroke of the scissors, the handles and the blades must be separated into opposing positions to permit the scissors to be folded into the handle of the tool for stowage without the movable blade's handle having to engage and flex the spring.

What is needed, then, are an improved mechanism for securely mounting and releasing selected tool blades so that they can be extended for use or folded into a stowage configuration with respect to a handle of multipurpose tool, and an improved folding scissors that can be larger in size than previously available folding scissors, yet can be placed into a folded configuration free of tension in a spring, so that the scissors can be stowed in a small cavity in a tool handle.

SUMMARY OF THE INVENTION

The present invention provides various aspects of hand tool construction to satisfy the aforementioned needs, among others, as defined by the claims appended hereto.

In particular, according to one aspect of the present invention, a tool holder is provided by which various tool blades or bits such as saw blades, knives, files, or other tools can be mounted securely in the tool holder and can be selectively removed and replaced from the tool holder. When mounted in the tool holder such tool blades are held securely in a manner permitting the mounted tool blades to be folded into a tool handle for stowage when not being used.

In one embodiment of that aspect of the invention the tool holder includes a carrier defining a tool base receptacle into which the base portion of a tool blade can be inserted laterally, where the tool base is then held securely by a tool retainer that moves pivotally with respect to the tool carrier to a position obstructing the lateral opening of the tool base receptacle.

In one preferred embodiment of this aspect of the invention the tool retainer has the form of a channel with a pair of opposite sides. The retainer is movable to a position in which each side of the channel extends closely along a respective side of the body of the tool carrier, preventing a tool blade base portion from being removed laterally from the tool base receptacle.

According to another aspect of the invention a folding scissors-action tool includes a main tool member handle for a first tool member. The main tool member handle is mounted so as to be movable about a pivot shaft, between an extended, operative, position and a stowed position in a tool handle. A spring located alongside the main tool member handle is arranged to engage a handle of a second tool member so as to urge the handles apart from each other when the scissors-action tool is in its extended, operative, position, but leaves the tool member handles free to move together so as to permit the scissors-action tool to be folded and stowed in a compact configuration within the tool handle.

In a preferred embodiment of this aspect of the invention the spring is free to move away from its position of engagement with the handle of the second tool member as long as the main scissors handle is not located substantially in the extended, operative position with respect to the tool handle.

According to yet a further aspect of the invention a handle of a multipurpose folding tool has a grip portion in which a grip member includes resilient grip bodies exposed through holes in a handle shell member so as to present easily grasped, comfortable, and slip-resistant outer surfaces of the grip bodies on outer sides of the tool handle.

The foregoing and other objectives, features and advantages of the invention will be more readily understood upon consideration of the following detailed description, taken in conjunction with the accompanying drawings.

BRIEF DESCRIPTION OF THE SEVERAL DRAWINGS

FIG. 13 is a partially cutaway side elevational view of the folding multipurpose tool shown in FIGS. 6–9, showing a folding scissors in an extended, operative position with respect to one handle of the tool.

FIG. 14 is a view of a portion of the folding multipurpose tool and folding scissors shown in FIG. 13, taken along line 14—14 of FIG. 13.

FIG. 15 is a partially cutaway side elevational view of the tool shown in FIGS. 13 and 14, with the scissors folded and stowed in one of the handles.

FIG. 16 is a partially cutaway side elevational view of the folding multipurpose tool shown in FIGS. 6–9, showing an alternative embodiment of a folding scissors in an extended, operative position with respect to one handle of the tool.

FIG. 17 is an isometric view of a portion of the folding scissors and one handle of the folding multipurpose tool shown in FIG. 16, taken from the lower left front of FIG. 16.

FIG. 18 is a partially cutaway side elevational view of the tool shown in FIGS. 16 and 17, with the scissors folded and stowed in one of the handles.

DETAILED DESCRIPTION OF THE PREFERRED EMBODIMENTS

Figure 20:
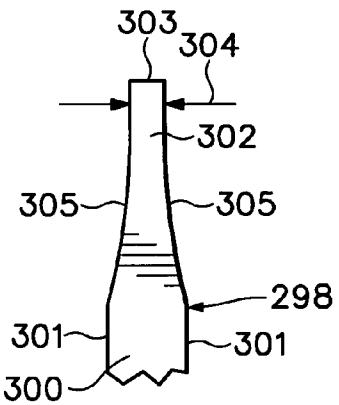
FIG. 20 is a detail view of a screwdriver blade of the folding multipurpose tool shown in FIG. 1, taken along line 20—20 of FIG. 1.

Referring now to the drawings which form a part of the disclosure herein, and referring first to FIGS. 1–5, a folding multipurpose tool 30 includes a pair of pliers 32 having a pair of folding handles 34 and 36. The pliers 32 include a pair of jaws 38 and 40 interconnected pivotally by a pliers pivot joint 42. The jaw 38 has a tang 44 to which the handle 36 is connected by a handle pivot joint 46. Similarly, the jaw 40 has a tang 48 connected with the handle 34 by a handle pivot joint 50.

At an outer, or rear end 52 of the handle 36 a foldable tool holder 54, in which a saw blade 56 is removably held, is shown in its extended, operative position with respect to the handle 36. It should be understood that while the tool holder 54 is shown herein associated with a two-handled multipurpose tool, it is equally useful in a one-handled folding tool.

Figures 2, 4:
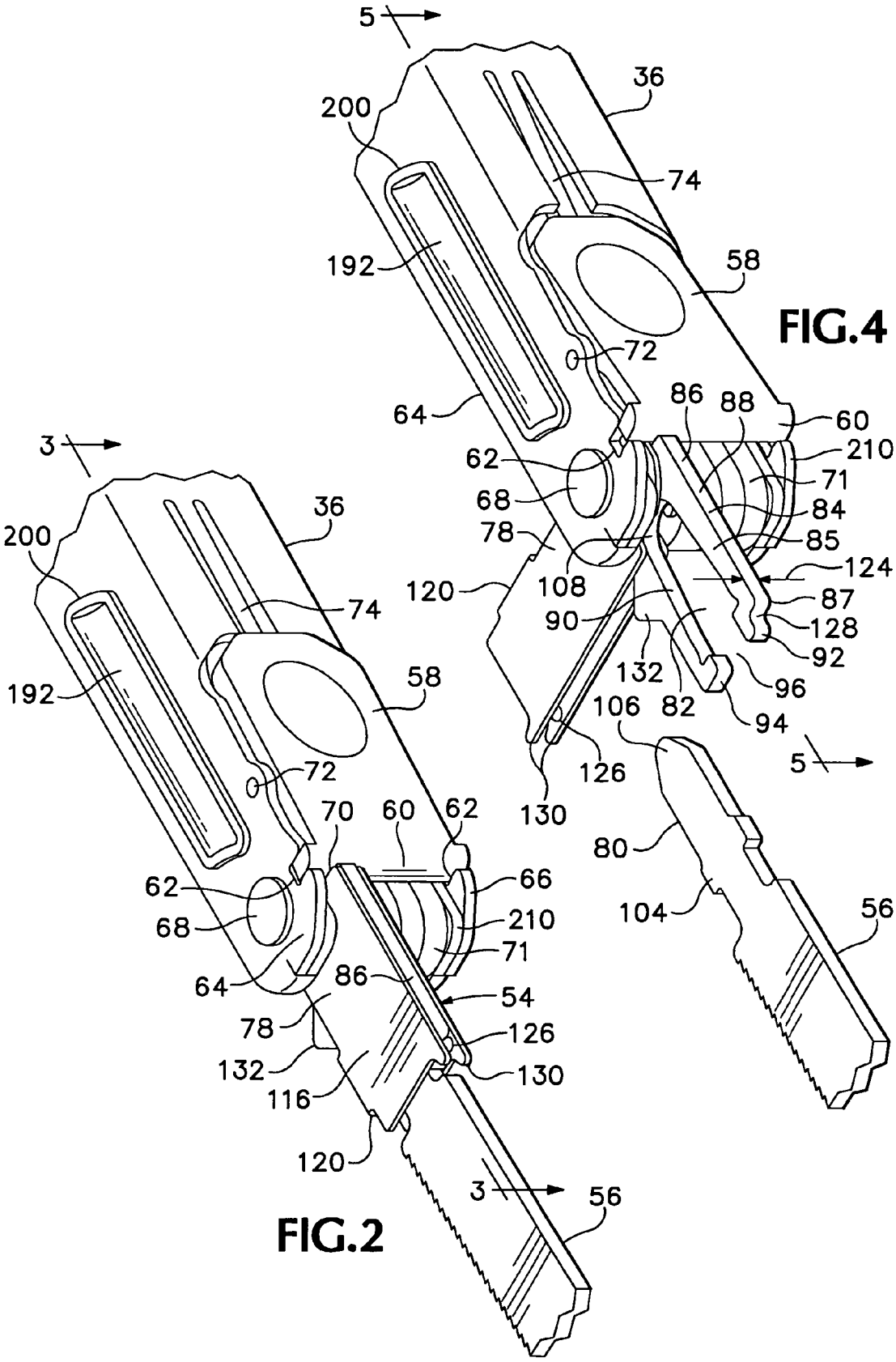
FIG. 2 is an isometric view of one end of one of the handles of the tool shown in FIG. 1, together with a saw blade held in an extended position with respect to the handle in a tool holder embodying one aspect of the present invention.
FIG. 4 is an isometric view of the portion of a tool handle shown in FIG. 2, showing the saw blade disengaged from the tool holder.

As shown in FIG. 2, a latch mechanism including a latch lever 58 is associated with the outer end 52 of the handle 36, and a transversely extending latching bar or finger 60 carried on the latch lever 58 is engaged in a respective mating notch 62 defined in each of the opposite side members 64 and 66 of the handle 36.

The tool holder 54 is attached to the handle 36 by a transversely extending pivot pin 68 mounted in the side members 64 and 66, but the tool holder 54 is prevented from rotation about the pivot pin 68 by engagement of the latch bar 60 in a latching notch 70, which holds the tool holder 54 in an extended position with respect to the handle 36 so the saw blade 56 can be used effectively. The latch lever 58 is attached to the handle 36 by a pair of trunnions 72 mounted in bearings defined respectively in the sides 64 and 66, and a spring 74 acting on the latch lever 58 urges the latch bar 60 into engagement in the notches 62 and 70 to keep the tool holder 54, or any selected one of various other folding tools 71 which may be carried in the handle 36, in its extended, operable position.

A cavity 76 defined inside the handle 36, between its side members 64 and 66, is long enough to receive the tool holder 54, together with the saw blade 56 mounted therein, when the latch bar 60 is removed from the latching notch 70 and the tool holder 54 is rotated about the pivot pin 68.

The saw blade 56, or another tool blade or bits held in the tool holder 54, may be released from the tool holder 54, as when a dulled saw blade must be replaced with a sharp one, or when it is desired to mount another tool, such as a file, in place of the saw blade 56 in the tool holder 54. This is accomplished, as shown best in FIGS. 4 and 5, by pivoting a tool retainer 78, which is part of the tool holder 54, from the position shown in FIGS. 1–3 through an angle 79 to a position such as that shown in FIGS. 4 and 5 in which a tool blade base such as the shank, or base portion 80 of the saw blade 56 is free to be disengaged from the tool holder 54 by being moved laterally out of engagement in the blade base receptacle 82 defined in the carrier body 84 of the tool carrier 86. Depending on the specific design of the tool retainer 78, an angle 79 of movement of at least 45° may be sufficient to provide the necessary clearance.

A rear, or base portion 89 of the tool carrier 86 is mounted pivotally on the pivot shaft 68, so the tool holder 54 can be rotated about an axis defined by the pivot pin 68 between its extended, operative position shown in FIG. 3 and a stowed position within the cavity 76, as mentioned previously and as shown in broken line in FIG. 3.

The body 84 of the tool carrier 86 preferably has a pair of planar parallel opposite lateral side 85 and 87 and includes an upper fork arm 88, and a lower fork arm 90, the pair of fork arms 88 and 90 together defining the blade base receptacle 82. In the tool carrier 86 as shown herein the blade base receptacle 82 extends entirely through the body 84 and is open on each lateral side 85 and 87 of the carrier body 84, as shown in FIG. 4, so that the saw blade bade portion 80 can be removed laterally from the tool carrier toward either side. The blade base portion 80 of the saw blade 56 tool is retained snugly, however, by the blade base receptacle 82, so that it is prevented from moving in the plane defined generally by the body 84 of the tool carrier 86, since inwardly offset tip portions 92 and 94 of the fork arms 88 and 90 define a front end opening 96 where the tip portions 92 and 94 are separated from each other by a front end opening height or distance 98. The inwardly offset tip portions 92 and 94 have rearwardly or inwardly, facing surfaces 100 and 102 partially defining the blade base receptacle 82. A blade base portion 80 of an available conventional design for replaceable blades for driven power reciprocating saws includes a cross arm portion 104, whose front surfaces fit matingly against the rearwardly facing surfaces 100, 102 when such a blade base portion 80 is held in the blade base receptacle 82.

A rear end 106 of such a conventional blade base portion 80 fits matingly against a rear inner surface 108 of the blade base receptacle 82, so the blade base receptacle 82 prevents longitudinal movement of the blade base 80 in the direction of the arrow 110 during use of a tool blade such as the saw blade 56. Inwardly facing opposing surfaces 112, 114, bear against top and bottom surfaces of the narrow part of the blade base portion 80 of the saw blade 56 to hold it snugly against up and down wiggling during use. Other top and bottom margin surfaces of the blade base portion 80 spaced rearwardly further apart from the surfaces 100 and 102 of the tip portions 92 and 94 also may bear against interior surfaces of the blade base receptacle 82. The blade base receptacle 82 has a height 115 greater than the front end height 98, between the upper fork arm 88 and the lower fork arm 90, at a location within the blade base receptacle 82 rearward from the inwardly facing rear surfaces 100 and 102, to accommodate a wider portion such as the cross arm 104 of the base portion 80 of a tool blade.

The surfaces 100, 102, 108, 112, and 114, defining the interior of the blade base receptacle 82, all preferably extend generally normal to the plane defined generally by the tool carrier body 84. With such construction of the tool carrier 86 the tool blade base portion 80 is held securely in the body 84, between the upper fork arm 88 and the lower fork arm 90, minimizing movement in a longitudinal direction as indicated by the arrow 110, or in any other direction parallel with the plane defined generally by the body 84 of the tool carrier 86.

The tool retainer 78, in the preferred embodiment of the tool holder 54 shown in FIGS. 1–5, is in the form of a channel, preferably made of a strong thin sheet metal such as a stainless spring steel sheet material about 0.024 inch (0.61 mm) thick, and includes a pair of side members 116 and 118 interconnected with each other by a channel base portion 120. A respective rear end portion of each of the side members 116 and 118 is mounted on the pivot pin 68, with the base 89 of the tool carrier 86 between the two side members 116 and 118.

The width of the channel base 120 is at least equal to and preferably slightly greater than the thickness 124 of the body 84 of the carrier 86, which may be 0.070 inch (1.78 mm). As a result, the sides 116 and 118 fit closely alongside the opposite lateral sides 85 and 87 of the body 84, covering openings of the blade base receptacle 82 on each lateral side of the body 84 and obstructing lateral movement of the blade base portion 80 of the saw blade 56 or other tool from the blade base receptacle 82. The material of the tool retainer 78 is preferably bent along the margins of the channel base 120 to bias the side members 116 and 118 toward each other so that they fit snugly alongside, and are urged into contact with, the opposite lateral sides 85 and 87 of the body 84 of the tool carrier 86 to retain the tool blade base portion 80 firmly within the blade base receptacle 82.

Figure 1:
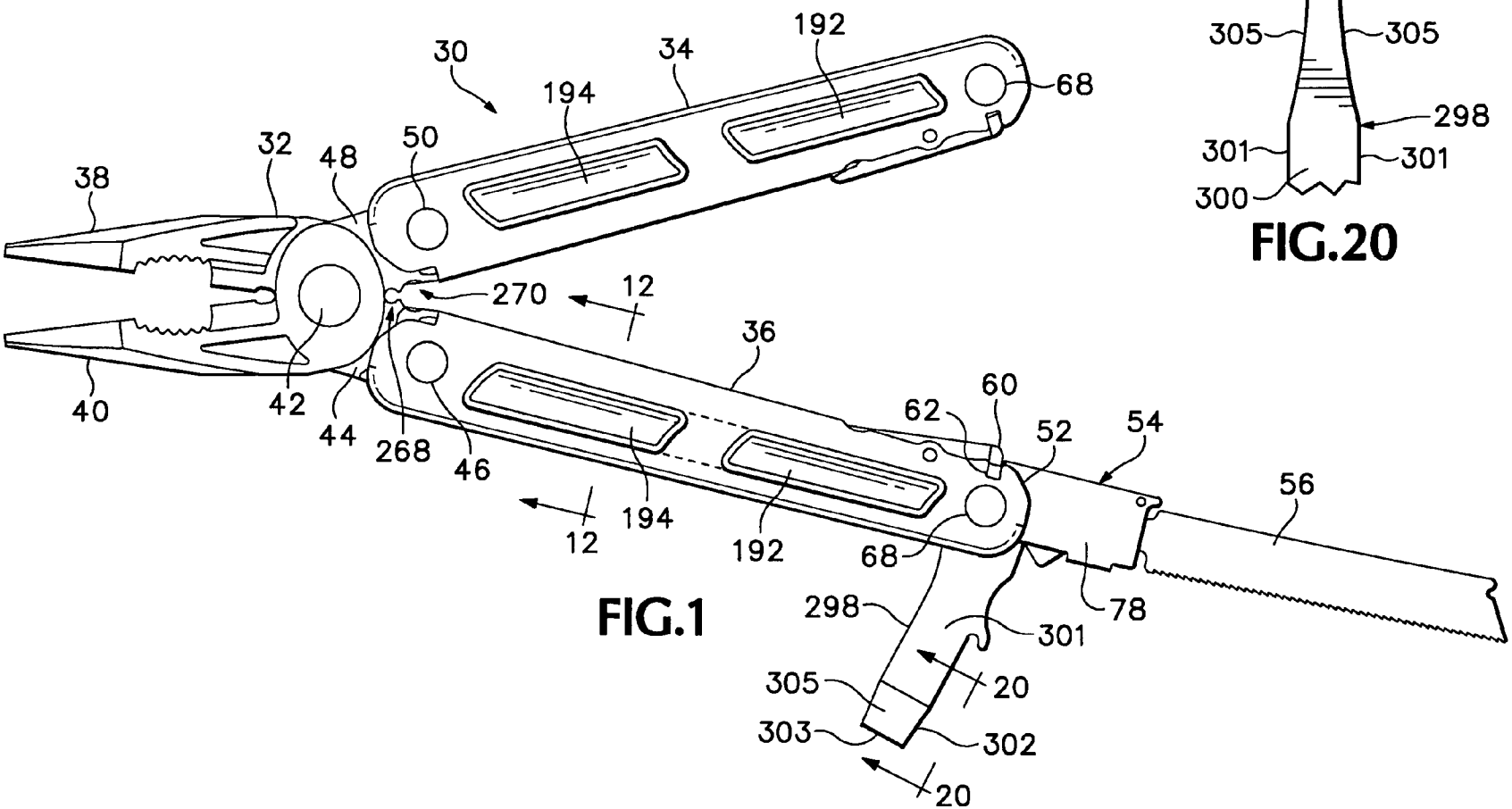
FIG. 1 is a side elevational view of a folding multipurpose tool embodying certain aspects of the present invention.
Figures 3, 5:
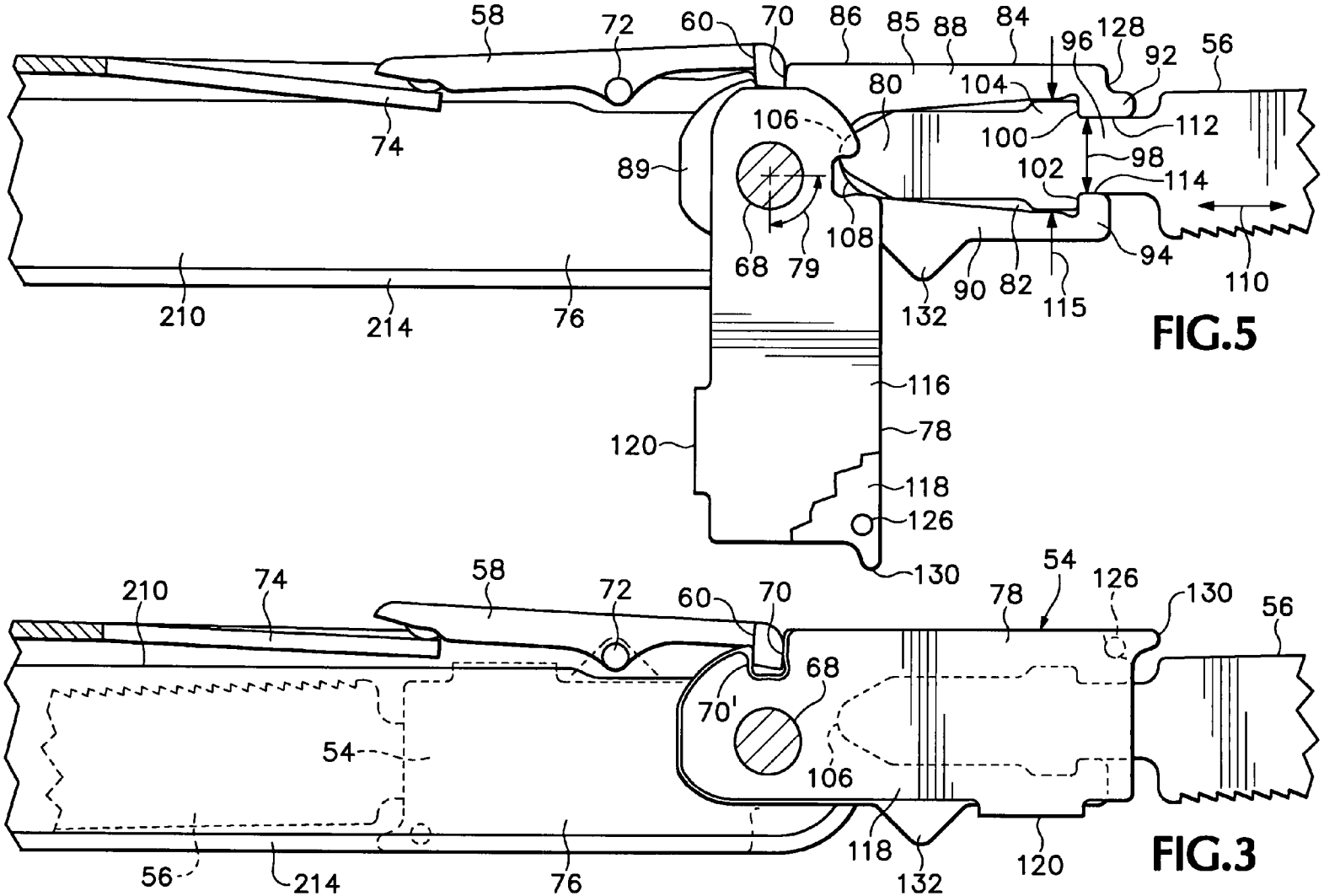
FIG. 3 is a sectional view taken along line 3—3 of FIG. 2.
FIG. 5 is a sectional view taken along line 5—5 of FIG. 4.
Figure 6:
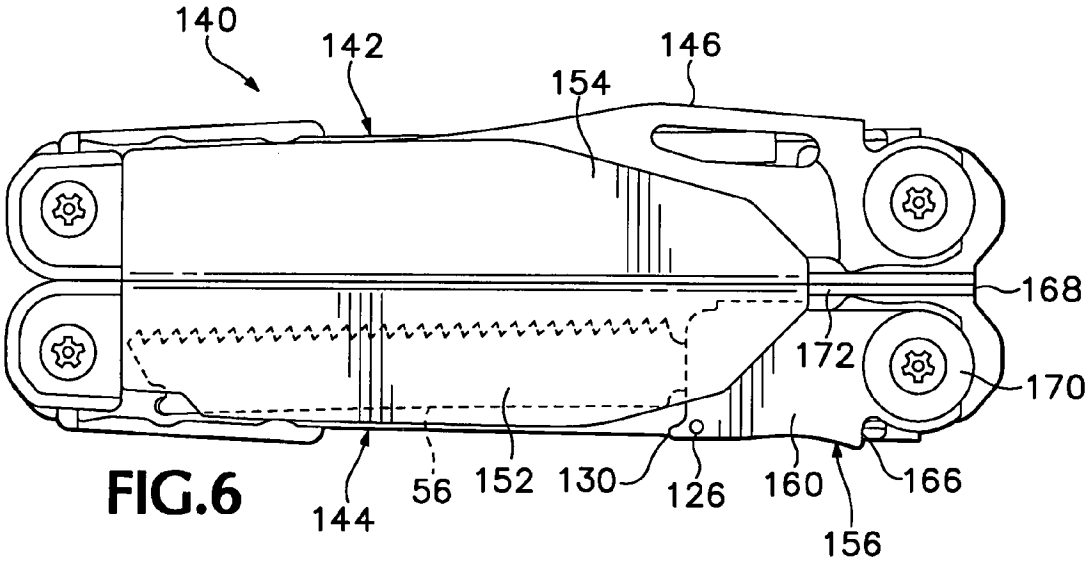
FIG. 6 is a side elevational view of a folded multipurpose tool including a blade holder which is an alternative embodiment of one aspect of the invention.
Figure 7:
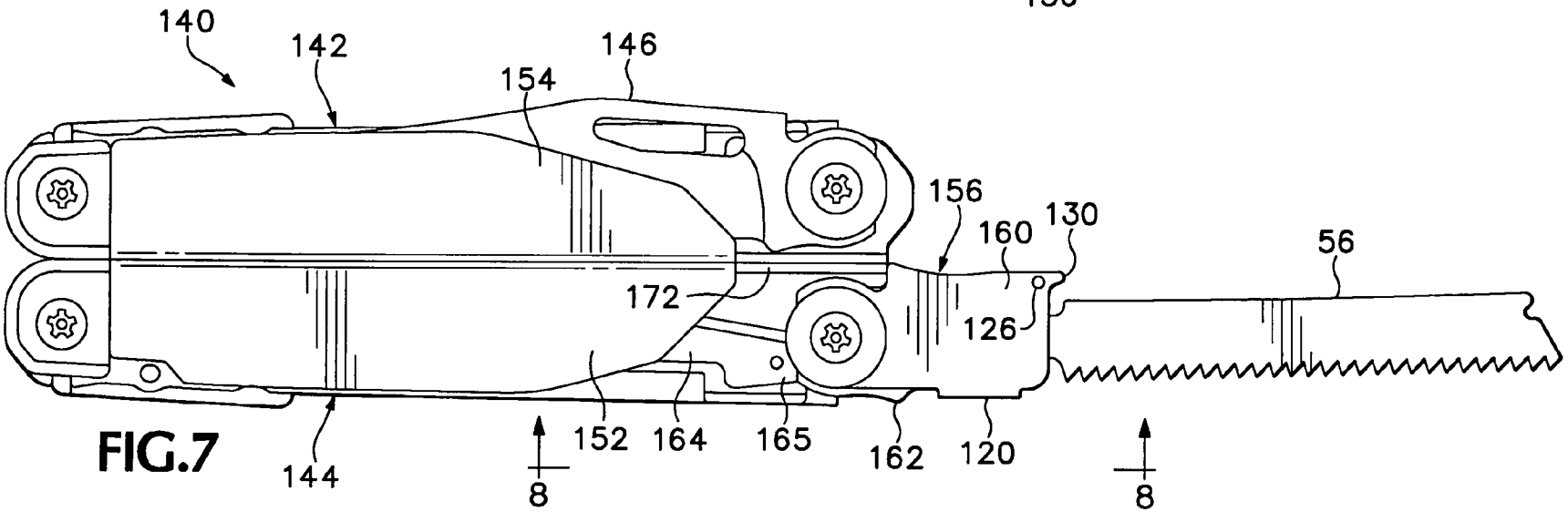
FIG. 7 is a side elevational view of the multipurpose folding tool shown in FIG. 6, with a saw blade held in a blade holder in an extended, operative position.

Preferably, a detent 126 is provided in the tool retainer 78 to keep the tool retainer 78 in its tool securing position with respect to the tool carrier 86, as shown in FIGS. 1, 2, and 3. The detent 126 may have the form, for example, of an inward bump formed in either or both of the sides 116 and 118 to engage a corresponding notch 128 in the tip portion 92 of the upper fork arm 88.

A notch 70' is provided in the rear, or base portion of each side 116 and 118 of the tool retainer 78, and is aligned with the notch 70 in the base portion 89 of the tool carrier 86 and engaged by the latching bar 60 when the tool retainer 78 is in the tool securing position and the tool holder 54 is in the extended position shown in FIGS. 1, 2, and 3.

Projecting ears 130 are provided on the front corners of the sides 116 and 118 of the tool retainer 78, where they can be engaged by one's finger nail to remove the tool holder 54 and any tool blade engaged therein from a stowed, or folded, position within the cavity 76 in the tool handle 36. A small projection 132 is provided on the lower fork arm 90, to keep the tool holder 54 from being moved to deeply into the cavity 76 in the tool handle 36, in order to protect a sharp edge of a tool held in the tool holder 54.

It will be understood that the tool retainer 78 could take other forms, such as separate pieces corresponding to the two sides 116 and 118, or that the tool retainer 78 could be attached pivotally to the body 84 of the tool carrier 86 by a separate pin or other fastener rather than being mounted on the pivot pin 68, if desired. It will also be understood that the blade base receptacle 82 might be formed as a cavity in the body 84 of the tool carrier 86, and open to only one side, with the other side of the body 84 remaining as a solid wall defining the blade base receptacle 82. With such a blade base receptacle 82 a tool retainer 78 with only a single side 116 or 118 moveable with respect to the body of 84 would be sufficient to selectively provide or obstruct access to the blade base receptacle 82.

Referring to FIGS. 6, 7, 8, and 9, a folding tool 140 includes a pair of handles 142 and 144 shown in a folded configuration. A pair of folded pliers (not shown) or other scissors-action tool interconnects the handles 142 and 144. Several folded tool blades (not shown) may be housed within a cavity defined within each of the handles 142 and 144, while other blades, such as knife blades 146 and 147 are folded and protectively housed in respective side troughs of each of the handles 142 and 144, such as the side troughs 148 and 150 defined by respective wing portions 152 and 154. A tool blade such as the saw blade 56 is connected with the handle 144 by a tool holder 156 which is similar in most respects to the tool holder 54 described above, and which can be moved between a stowed position in the side trough 148 and an extended position with respect to the handle 144. As with the previously described tool holder 54, it should be understood that the tool holder 156 could also be associated usefully with a folding tool having only a single handle such as the handle 144 or of a different design.

The tool holder 156 includes a tool carrier 158 and a tool retainer 160. The tool carrier 158 is similar to the tool carrier 86 except that it has a much smaller projection 162 instead of the larger projection 132 from its lower fork arm 90', and the base of the tool carrier 158 has no latch receptacle notch 70, but is instead shaped to cooperate with a latch mechanism of the type commonly called a liner lock, located in a side of the tool handle 144. This latch mechanism includes a spring 164 arranged to urge the latching member 165 laterally outwardly from an inner wall 174 of the side trough 148 to engage the base of the tool carrier 158 when the tool is in its extended position with respect to the handle 144.

Figure 8:
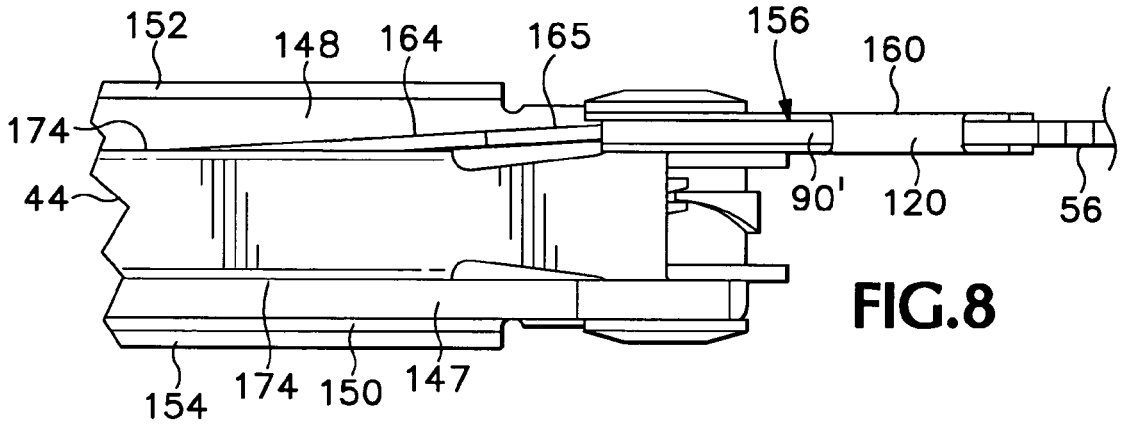
FIG. 8 is a view of a portion of the tool shown in FIG. 7, taken along line 8—8 in FIG. 7.
Figure 9:
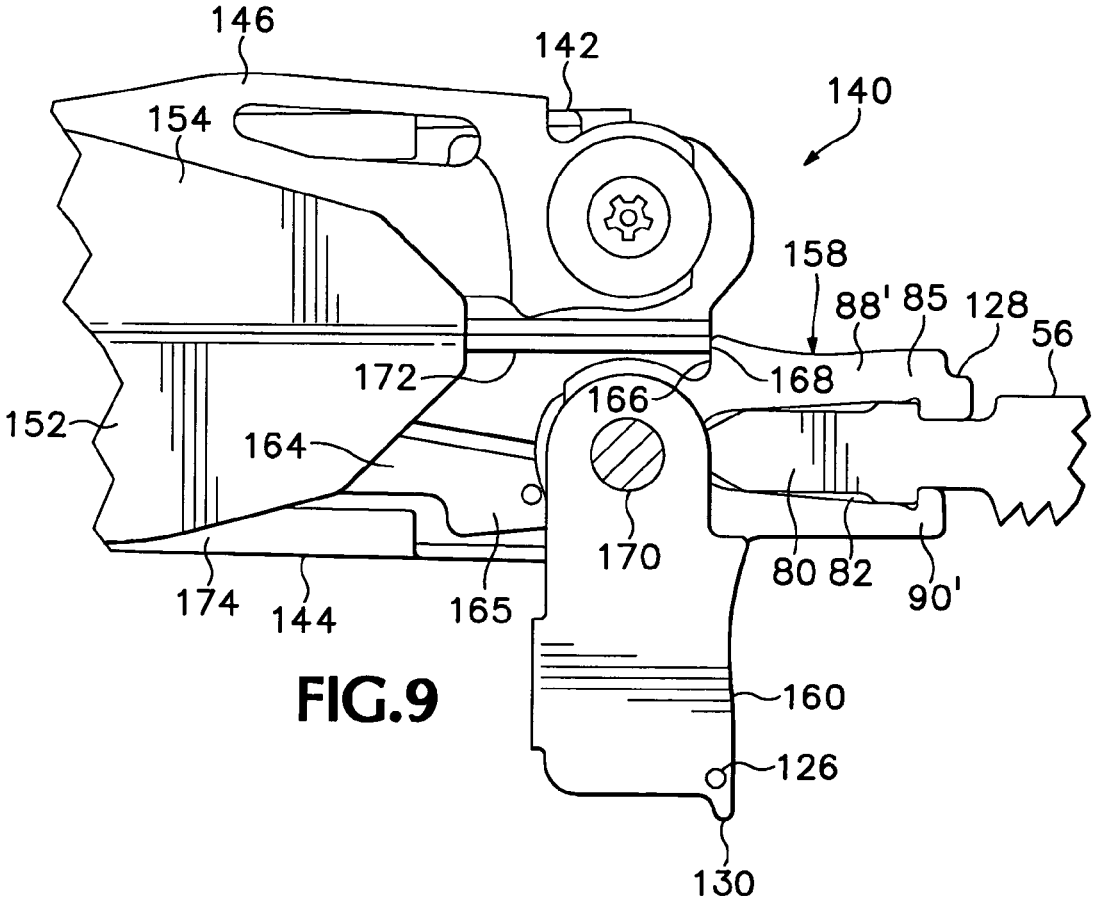
FIG. 9 is a side elevational view of a portion of the tool shown in FIGS. 6–8, showing a tool retainer in a tool-releasing position with respect to a tool carrier.

As seen best in FIG. 8, the tool handle 144 includes a center channel portion which may house various tool blades and bits and where the bases of pliers jaws are also attached, while the side troughs 148 and 150 are directed openly in the opposite direction from the central channel. The upper fork arm 88' of the tool carrier 158 includes, at its rear end, a projection with a rear face 166 that confronts an abutment face 168 at the end of the handle 144, when the tool holder 156 is moved about a pivot shaft 170, to the fully extended, operative position of the tool holder 156.

The pivot shaft 170 is mounted in and extends laterally from the center channel portion of the handle 144, which includes the inner wall 174 of the side trough 148. The tool holder 156 is kept in the extended, operative position by the action of the engaged latching member 165 of the latch mechanism on the rear of the tool carrier 158, while the rear face 166 of the projection on the upper arm 88' of the tool carrier 158 bears on the abutment face 168 of the end of the handle 144, keeping the tool carrier 158 from being moved outward beyond the fully extended position of the tool holder 156. The tool retainer 160 is not engaged by the latching member 165, and so the detent 126 keeps the tool retainer 160 engaged with the tool carrier 158 in the tool securing position of the tool retainer 160.

When it is desired to disengage the tool retainer 160 from the tool carrier 158 or to disengage the tool retainer 78 from the tool carrier 86, the ears 130 can be pushed to overcome and disengage the detent 126, and thereafter the tool retainer 160 or 78 can be rotated with respect to the tool carrier 158 or 86 to a position clear of the blade base receptacle 82 to allow the base portion of the tool blade to be removed laterally from the blade base receptacle 82.

A respective flange 172 extends laterally outward from each side wall 174 of the center channel at the outer end of each handle 142 and 144 and continues therefrom to the front end of each side wing 152 and 154. The flange 172 includes the abutment face 168, Referring again to FIGS. 1–5 and also referring to FIGS. 10–12, the handle 36 of the folding multipurpose tool 30, to which the handle 34 is similar, is shown in an exploded view in FIG. 10. The handle 36 includes a handle frame or shell 180 preferably made of metal such as stainless steel sheet, cut and pressed into a desired shape such as that shown. Each of the sides 182 and 184 defines holes, such as for a pivot pin of the handle joint 50 and for the pivot pin 68 for folding tools at the outer end of the handle. Each side 182 and 184 also defines a pair of openings 186, 188 spaced apart from each other longitudinally along the handle 34.

Figure 10:
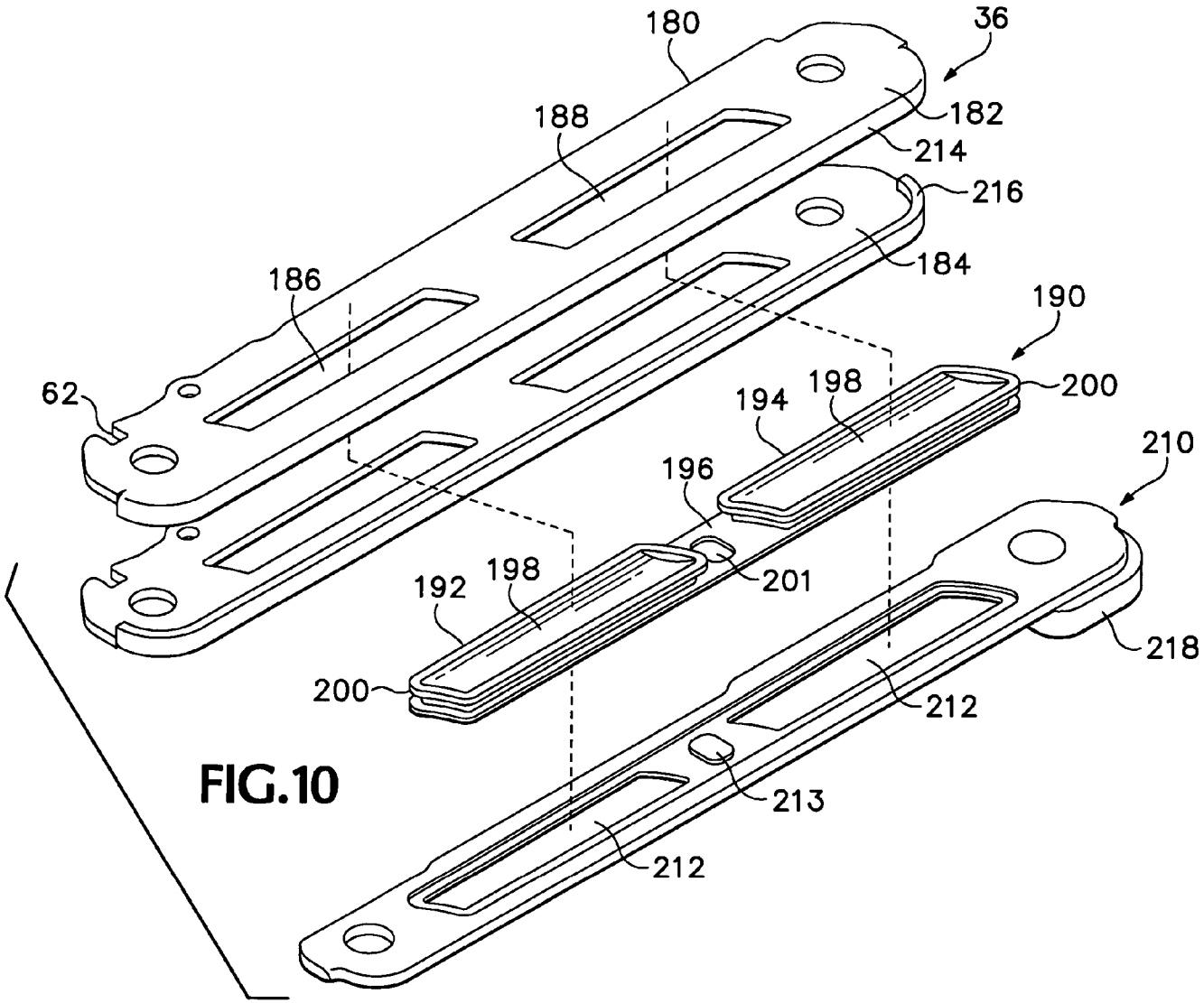
FIG. 10 is an exploded isometric view of parts of a handle for a folding multipurpose tool such as that shown in FIGS. 1–5.

A pair of mirror opposite grip members 190 are installed in the handle frame shell 180. One grip member 190 is mated with each side 182 and 184, although only one grip member 190 is shown in FIG. 10, for the sake of simplification. Each grip member 190 includes a pair of grip bodies 192 and 194 mounted on, and interconnected with each other by, a back portion 196 that is generally flat and ribbon-like. The grip members 190 are preferably made of a resiliently flexible and compressible moldable synthetic rubber-like material having a comfortable, non-slippery composition, so that the grip bodies can be gripped comfortably and will resist slipping in the hand of a user. Each grip body 192 and 194 fits snugly in a respective one of the openings 186 and 188.

An outer face of each grip body 192, 194, defines a shallow, longitudinally-extending, trough-like depression 198 shaped to receive at least one finger tip comfortably, and a respective flange 200 surrounds and extends radially outward from a central part of the grip body 192 or 194 which defines the depression 198. The flange 200 thus extends closely along the outer surface of the respective side 182 or 184 of the handle shell 180. The back portion 196 fits closely alongside the inner surface of the handle shell 180 between the openings 186 and 198, with parts of the back portion 196 extending as flanges around the openings 186, 188 on the inner surface of the respective side 182 or 184 of the handle shell 180.

Figure 11A:
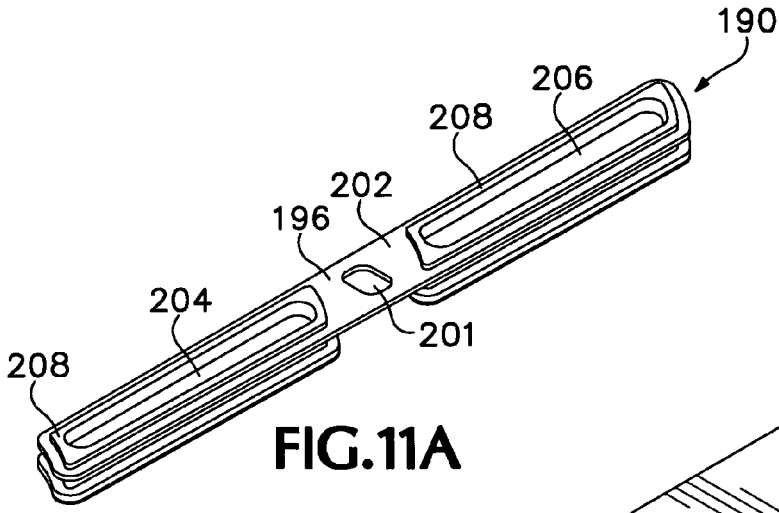
FIG. 11A is an isometric view of the grip member portion of the handle shown in FIG. 10, taken from the opposite side.
Figure 12:
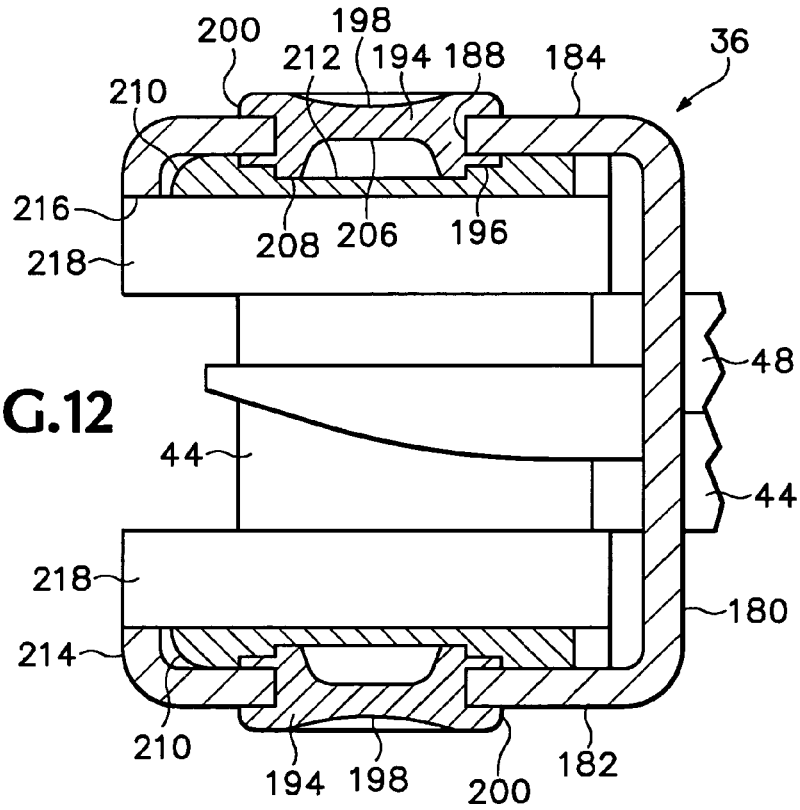
FIG. 12 is a sectional view, at an enlarged scale, taken along line 12—12 in FIG. 1.

As may be seen best in FIG. 11A, an inner face 202 of the grip member 190 includes cavities 204, 206, aligned respectively behind the grip bodies 192, 194, and each cavity 204, 206 is surrounded by a raised rim 208.

Additional, or differently-shaped, openings and corresponding grip bodies could be used instead of the two openings 186 and 188 and the grip bodies 192 and 194, with each such grip body preferably connected to at least one other by a back portion 196, so that each grip body helps to retain another from being removed outwardly from the handle.

Figure 11B:
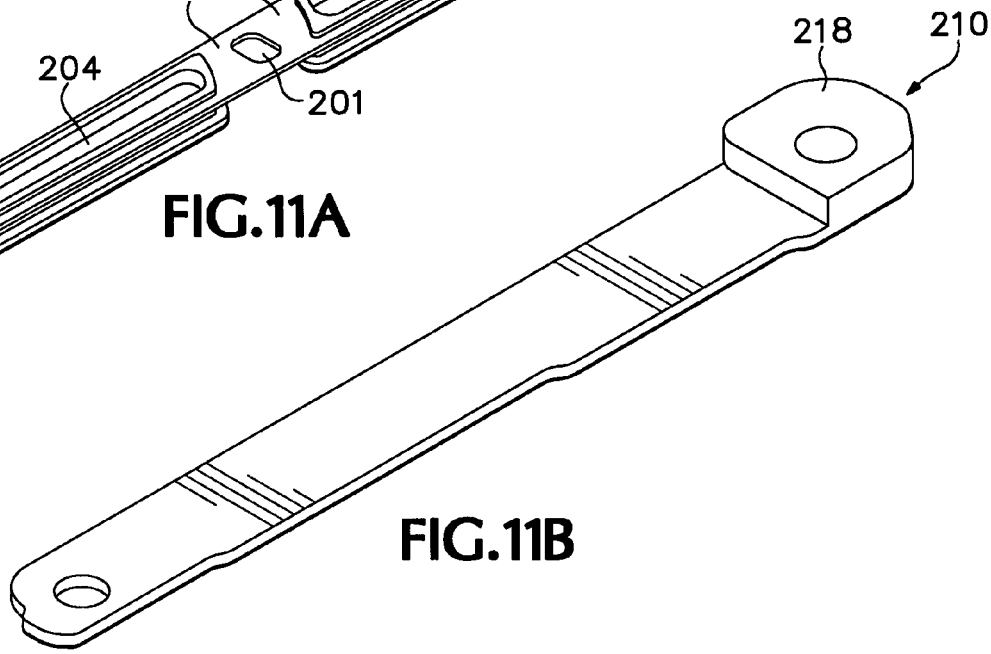
FIG. 11B is an isometric view of the support member portion of the handle shown in FIG. 10, taken from the opposite side.

A support member 210, as shown in FIGS. 10 and 11B, is preferably of a strong molded plastic material, such as a glass-filled Nylon that is harder and stiffer than the material of the grip number 190. The support member 210 defines a cavity 212 shaped to receive the inner, or back, side of the grip 190 snugly, to press it against the inner surface of the respective side 182 or 184 of the handle shell 180. A projecting retainer body 213 on the support member 210 fits matingly in the hole 201 defined in the back portion 196 between the grip bodies 192 and 194 to enhance secure engagement of the grip member 190 in the handle.

The grip members are 190 installed in the handle shell 180 by squeezing each of the grip bodies 192, 194 in turn, to pass its flange 200 through the respective opening 186 or 188, and then allowing it to return its original shape, so that the respective flange 200 extends outward around the opening 186 or 188 on the outer side of the handle shell side 182 or 184 and the back portion 196 rests against the inner surface of the handle shell 180. Thereafter, the support member 210 is placed against the inner face 202 of the grip member 190, receiving the grip member 190 in the cavity 212. The support member 210 extends around the grip member 190 and rests against the inner surface of the handle shell side 182 or 184, with its projecting retainer body 213 in the hole 201. A respective inwardly directed rim 214 or 216 of the handle shell side 182 or 184 rests against and protects a longitudinal margin of each support member 210.

If it is desired to provide only a single opening in place of the two openings 186 and 188 the associated grip member (not known) would preferably include a back portion extending in both directions from grip body, with a hole in the back portion for a projecting retainer body 213 near each end of the grip body.

A pair of mirror opposite support members 210 are used respectively for the opposite sides 182 and 184. A spacer body 218 at one end of each support member 210 is used to centrally locate the respective tang 44 or 48 of the jaws 38 and 40 of the pliers 32, as seen best in FIG. 12. At the other end of the handle 34 or 36 various tool blades 71 mounted pivotally on the pivot pin 68 occupy the space between the support members 210 associated respectively with the opposite shell sides 182 and 184, so that the support members 210 do not need to be fastened in place by an adhesive.

Referring next to FIGS. 13, 14, and 15, the folding tool 140 may also have associated therewith a folding scissors-action tool, such as the folding pair of scissors 222, shown extended and ready for use with respect to the handle 142 in FIGS. 13 and 14 and stowed in a folded configuration within a stowage cavity in the handle 142, such as the side trough 148, in FIG. 15. It will be understood that instead of the scissors 222 shown herein such a scissors action tool might be a small pliers with gripping jaws, or another type of cutting tool including opposing blades. It will also be apparent that such a folding tool could be incorporated in a more centrally located cavity in a tool handle, and that it could be associated with a single-handled folding tool, as well as the two-handled tool 140.

A longer scissors handle, or main tool member handle 224, of the scissors 222 is mounted pivotally on a tool pivot shaft 171 of the handle 142, about which the main tool member handle 224 is moveable from the extended position shown in FIGS. 13 and 14 to the folded, stowed position shown in FIG. 15. When the main tool member handle 224 is in the extended position shown in FIGS. 13 and 14, a liner lock mechanism, including a spring 164 and a liner lock latching body 165, engages the base of the main tool member handle 224 in the well known manner, while a projecting corner 226 of the main tool member handle engages the abutment face 168 of the flange 172 so that the main tool member handle 224 is held immobile with respect to the handle 142.

A second tool member 228 is connected with the main tool member handle 224 at a scissors pivot joint 230. A blade member 232, mounted on the main tool member handle 224, extends forward from the scissors pivot joint 230, and a blade member 234 of the second tool member 228 and a handle 236 of the second tool member 228 extend respectively forward and rearwardly from the scissors pivot joint 230. As shown herein the blade members 232 and 234 are scissor blades, but in other versions of the folding scissors-action tool they could be other tool blades, such as pliers jaw or clipper blades, for example. In a preferred embodiment of the scissors action tool the handle 236 includes a comfortable handle grip portion 238 of a suitable molded thermoplastics material engaged, as by a sonic staking method, with the handle 236.

When the main tool member handle 224 is held in the extended position by the liner lock mechanism, as shown in FIGS. 13 and 14, a tip 240 of a spring 242 engages a back surface of the handle 236, while a shoulder 244 of a base portion 246 of the spring 242 is supported by contact against a inner surface of the flange 172, as is seen best in FIG. 13. The flange 172 forces the spring 242 into an operative position in which the spring tip 240 urges the handle 236 away from the handle 224, thus opening the blades 232 and 234 apart from each other.

The base 246 of the spring 242 is attached to the base of the main scissors handle 224 by a pivot pin 248 engaged in mating bores defined respectively in the base portion 246 of the spring 242 and in the base of the main tool member handle 224 as can be seen in FIG. 15, where the end bearing and retainer are omitted from the pivot shaft 171. The spring 242 can pivot through a small angle about the pin 248, alongside the main scissors handle 224. The angle is limited, however, by a linkage between the base portion 246 of the spring 242 and the base of the main tool member handle 224. Thus, in the scissors as shown herein free space is available for a linking member, such as a pin 250 mounted securely in the base portion 246, to move within a hole 252 defined in the base of the main tool member handle 224 allowing some relative pivoting movement about the pivot pin 248. While the pin 250 could be a separate piece fitted into a corresponding bore defined in the base portion 246 it may preferably be made by partially piercing the base portion of the spring 242 using a suitable punch and die combination.

As shown best in FIG. 13, movement of the handle 236 toward the handle 224 in the direction of the arrow 254 to move the blade portions 232 and 234 together during use of the scissors action tool results in the spring 242 being flexed by the movement by the handle 236, so that when the handle 236 is released the spring 242 urges the handle 236 away from the handle 224, toward the position of the handle 236 shown in FIG. 13. Unless the main tool member handle 224 is in or at least nearly in the fully extended position shown in FIG. 13, however, the spring 242 is free to move with respect to the main scissors handle 224 about the pivot pin 248 within the limited angle established by the relationship between the linking pin 250 and the hole 252.

That is, when the shoulder 244 is not in contact with and supported by the flange 172 the spring 242 is free to be moved far enough about the pin 248 so that its tip 240 no longer urges the handle 236 away from the handle 224, and the handles 236 and 224 can be moved to positions alongside each other. Thus, as soon as the liner lock mechanism has been disengaged from the base of the main handle 224 and the main handle 224 has been pivoted about the pivot shaft 171 through at least a small angle away from the fully extended position shown in FIGS. 13 and 14, the blade portions 232 and 234 can be placed alongside each other as shown in FIG. 15, and the scissors-action tool can be folded freely into the stowed position within the side trough 148 as shown in FIG. 15. This configuration provides the possibility of using longer handles than if the handles had to be extended in opposite directions to fold and stow the tool.

The ability to fold a scissors-action tool such as the scissors 222 with the blade portions 232 and 234 together makes use of such a tool more intuitive and safer than a folding scissors in which the blades must be separated to fold the scissors into a tool handle. That is, the scissors blade points and edges are not exposed alongside the opposite handles and thus are not as likely to cut a user in the process of unfolding the tool from stowage in the tool handle 142.

Another desirable result of this configuration is that the scissors 222 or other scissors-action tool can be freely moved away from the stowed position shown in FIG. 15 toward the fully extended position until the main handle 224 has approached within a small angle, such as about 5 degrees, from the fully extended position before the shoulder 244 of the spring 242 engages the flange 172 and the spring 242 begins to urge the handles 236 and 224 apart from each other.

In a similar folding scissors-action tool such as the scissors 258 shown in FIGS. 16, 17, and 18 the mechanism is essentially the same and the same reference numerals are used with the respect to like parts. A principal difference is that a spring 260 that is otherwise similar to the spring 242 includes a base 262 portion that has a radially projecting spur 264 instead of the shoulder 244 of the spring 242. The spur 264 engages the abutment face 168 on the end of the flange 172 when the scissors-action tool is moved to the fully extended, ready-for-use configuration shown in FIGS. 16 and 17, placing the spring 260 in a definite operative position when the scissors-action tool is fully extended.

As with the scissors 222, the scissors 258 can be moved from its fully extended position upon release of the liner lock latching member 165.

Figure 19:
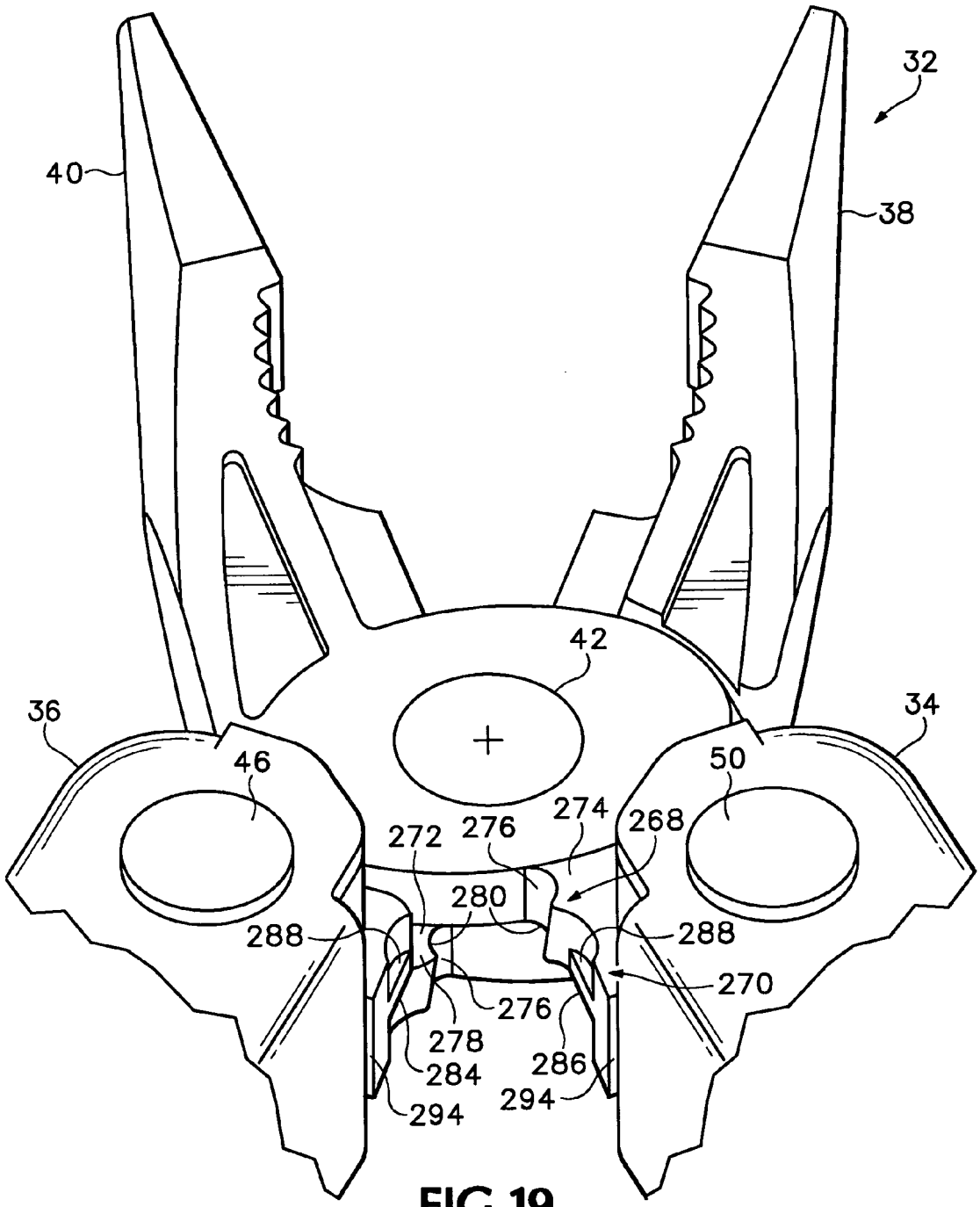
FIG. 19 is an isometric view taken from between the handles of the pliers jaws of the folding multipurpose tool shown in FIGS. 1—5, showing a wire cutter and a crimping tool included in that tool.

As shown best in FIG. 19, the pliers 32 of the multipurpose tool 30 include a bypass shears type wire cutter 268 and a crimping tool 270 included in the tangs 44 and 48 of the pliers jaws 38 and 40. In particular, substantially identical wire cutter blade portions 272 and 274 each include a concave wire support face 276 and a planar side face 278 meeting the wire support face 276 to form a sharp edge 280. Preferably, the wire support faces 276 intersect the planar side faces 278 at right angles along the edge 280, providing ample support for a hard wire to be cut, so that the blade portions 272 and 274 are not deformed by use in cutting hard wires. The pliers pivot joint 42 supports the wire cutter blades 272 and 274 so that the planar side faces 278 pass by each other preferably substantially in pressing contact with each other to cut a wire with a bypass shearing action, rather than with a knife-edge cutting action upon each side of a wire being cut.

Because the wire cutter 268 is located rearward of the pliers jaw pivot joint 42 it can in some situations be located closer to the pivot axis of the pliers pivot joint 42 than a wire cutter included in the pliers jaws 38 and 40 of a folding multipurpose tool, where the additional material needed for jaw strength requires wire cutter portions of the jaws to be located further from the pivot axis of the pliers pivot joint 42. As a result, in such a situation a greater shearing force can be applied to a wire for a given force applied to the folding handles 34 and 36, using the wire cutter 268 instead of one associated with the jaws 38 and 40. In any case, however, the location of the wire cutter 268 between the tangs 44 and 48 permits an additional, different, cutter or other tool requiring significant force to be located at the roots of the jaws 38 and 40.

Located immediately rearward from the wire cutter 268 and thus the spaced slightly further apart from the pivot axis of the pliers pivot joint 42, the crimping tool 270 includes opposing crimping members having narrow centrally located pressing faces 284 and 286. The crimping members are aligned normal to the pivot axis of the pliers pivot joint 42 and opposite each other, in position to approach each other closely once the wire cutter blades 272 and 274 have passed by each other and the pliers jaws 38 and 40 have moved to a fully closed position, although in use the pressing faces 284 and 286 would be separated by a article being crimped. A space 288 is provided along each side of each pressing face, so the pressure of the crimping tool is concentrated as required over a small area of an article such as a solderless electrical connector or a terminal being fastened to a bared wire by being crimped in place using the crimping tool 270.

An abutment block 294 is provided on each of the tangs 44 and 48, to be engaged by the back, or channel-base portion of the respective one of the handles 34 and 36 so that force can be exerted by the handles 34 and 36 on the tangs 44 and 48 to operate the pliers 32 and the wire cutter 268 and crimping tool 270 carried on the tangs 44 and 48.

As shown in FIGS. 1 and 20 a screwdriver blade 298 has a main portion 300 including parallel flat opposite sides 301, and a thinner tip portion 302 defining an edge 303 having a thickness 304 produced by grinding or otherwise shaping each side 305 of the tip portion 302 to a concave or hollow-ground configuration, as by use of a grinding wheel. As a result, the tip portion has less tendency for the opposite sides 305 to force the edge 303 out of a slot in a screw head by cam action, since the sides 305 are nearly parallel near the edge 303. Such a hollow-ground configuration provides that the tip portion 302 has nearly the desired thickness 304 over a greater portion of the length of the tip portion 302 away from its edge 303 than is provided with a flat-sided, wedge-like shape of the tip portion of a conventional screw driver. The hollow-ground configuration also allows the full thickness portion of the blade 298 to continue closer to the tip portion 302 than in a conventional blade with flat angled faces.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A tool holder for a multipurpose hand tool, comprising:

(a) a tool carrier body having a pair of opposite sides and an open front end, said carrier body defining a tool base receptacle and a respective lateral opening communicating with said receptacle on at least one of said opposite sides of said carrier body, and said receptacle being in communication with said front end of said carrier body;

(b) a tool retainer mounted pivotally with respect to said carrier body and movable between a tool-securing position, wherein said tool retainer obstructs each said lateral opening communicating with said receptacle, and a tool-releasing position, wherein said retainer is clear of each said lateral opening.

2. The tool holder of claim 1 wherein said tool base receptacle includes one said respective lateral opening on each of said opposite sides of said carrier body and wherein said tool retainer includes a pair of side members, each of which obstructs said respective lateral opening on a respective one of said opposite sides of said carrier body when said retainer is in said tool-securing position.

3. The tool holder of claim 2 wherein said tool retainer includes a pair of said side members spaced laterally apart from each other and interconnected with each other to form a channel, said tool base receptacle being located within said channel when said retainer is in said tool-securing position.

4. The tool holder of claim 1 wherein said tool retainer is movable through a predetermined angle between said tool-securing position and said tool-releasing position.

5. The tool holder of claim 1 wherein said tool base receptacle extends laterally through said carrier body and includes one said respective lateral opening on each of said opposite sides of said tool carrier body.

6. The tool holder of claim 1 wherein said tool retainer includes a pair of said side members, each of said side members being located closely adjacent to a respective one of said opposite sides of said carrier body when said tool retainer is in said tool-retaining position.

7. The tool holder of claim 1 wherein said tool retainer includes a detent arranged to cooperate with said carrier body to hold said tool retainer in said tool-securing position with respect to said tool carrier body.

8. The tool holder of claim 1 wherein said carrier body includes a pair of generally parallel fork arms each having a front end including an inwardly offset tip portion including a rearwardly-facing interior surface of said tool base receptacle, said tip portions defining said open front end of said tool carrier body and being spaced apart from each other by a first distance, said fork arms being separated from each other by a greater distance than said first distance at a location spaced rearwardly apart from said tip portions thereof.

9. The tool holder of claim 1 including a latch mechanism associated with a handle of said multipurpose tool and selectively engageable to hold said tool holder in an extended position with respect to said handle.

10. The tool holder of claim 9 wherein said tool retainer includes a latch receptacle selectively engageable by said latch mechanism to hold said tool retainer in said tool-securing position when said tool holder is in said extended position with respect to said handle.

11. The tool holder of claim 9 wherein said latch assembly engages both said tool carrier and said tool retainer and holds said tool retainer in said tool-securing position with respect to said body of said tool carrier when said tool holder is in said extended position with respect to said handle.

12. The tool holder of claim 9 wherein said latch mechanism includes a latching member urged laterally into engagement with a base of said tool carrier body by a spring carried in said handle.

* * * * *